US010168091B2

(12) United States Patent
Mahncke

(10) Patent No.: US 10,168,091 B2
(45) Date of Patent: Jan. 1, 2019

(54) AIR CONDITIONING COMPANION STABILIZER SYSTEM

(71) Applicant: Allen John Mahncke, Colfax, CA (US)

(72) Inventor: Allen John Mahncke, Colfax, CA (US)

( * ) Notice: Subject to any disclaimer, the term of this patent is extended or adjusted under 35 U.S.C. 154(b) by 363 days.

(21) Appl. No.: 14/465,772

(22) Filed: Aug. 21, 2014

(65) Prior Publication Data

US 2015/0075190 A1 Mar. 19, 2015

Related U.S. Application Data

(60) Provisional application No. 61/870,113, filed on Aug. 26, 2013.

(51) Int. Cl.

| | |
|---|---|
| ***F25D 17/02*** | (2006.01) |
| ***F25B 40/02*** | (2006.01) |
| *F25B 40/06* | (2006.01) |

(52) U.S. Cl.

CPC ..... *F25D 17/02* (2013.01); *F25B 40/02* (2013.01); *F25B 40/06* (2013.01); *F25B 2400/24* (2013.01)

(58) Field of Classification Search

CPC ..... F25D 17/02; F25B 2400/24; F25B 40/06; F25B 40/02; F25B 1/00; F25B 39/04; F25B 41/04

USPC ..... 62/344

See application file for complete search history.

(56) References Cited

U.S. PATENT DOCUMENTS

| | | | | |
|---|---|---|---|---|
| 4,608,836 | A * | 9/1986 | MacCracken | F24F 3/001 165/59 |
| 2009/0025405 | A1* | 1/2009 | Yanik | F25B 40/00 62/117 |
| 2013/0000341 | A1* | 1/2013 | De Piero | F28D 9/0062 62/228.1 |
| 2013/0145780 | A1* | 6/2013 | Parsonnet | F25B 1/00 62/115 |

* cited by examiner

*Primary Examiner* — Ana Vazquez
(74) *Attorney, Agent, or Firm* — Heisler & Associate

(57) ABSTRACT

An air conditioning companion stabilizer system for improving the operating cooling efficiency of refrigeration cycle components in air conditioning systems integrates the refrigeration cycle components with two independent, closed loops whose operation is complementary of one another. A temperature stabilizing loop functions in ambient conditions that lower cooling efficiency and is operative to absorb heat from the refrigerant exiting the condenser, thereby lowering the temperature of the refrigerant before it arrives at the expansion valve. A secondary loop, or charging loop operating in ambient conditions that enable optimal cooling efficiency facilitates the operation of the temperature stabilizing loop by priming a rechargeable heat absorbing component. Substantial net energy savings are achieved using saved heat absorbing capacity produced during a time of optimal cooling efficiency and low space cooling demand to improve performance during times of reduced cooling efficiency and high space cooling demand.

19 Claims, 5 Drawing Sheets

AIR CONDITIONING COMPANION STABILIZER SYSTEM

CROSS REFERENCE TO RELATED APPLICATIONS

This application claims the benefit of and incorporates by reference co-pending U.S. provisional patent application Ser. No. 61/870,113 filed Aug. 26, 2013.

DETAILED DESCRIPTION OF THE INVENTION

Figure 1:
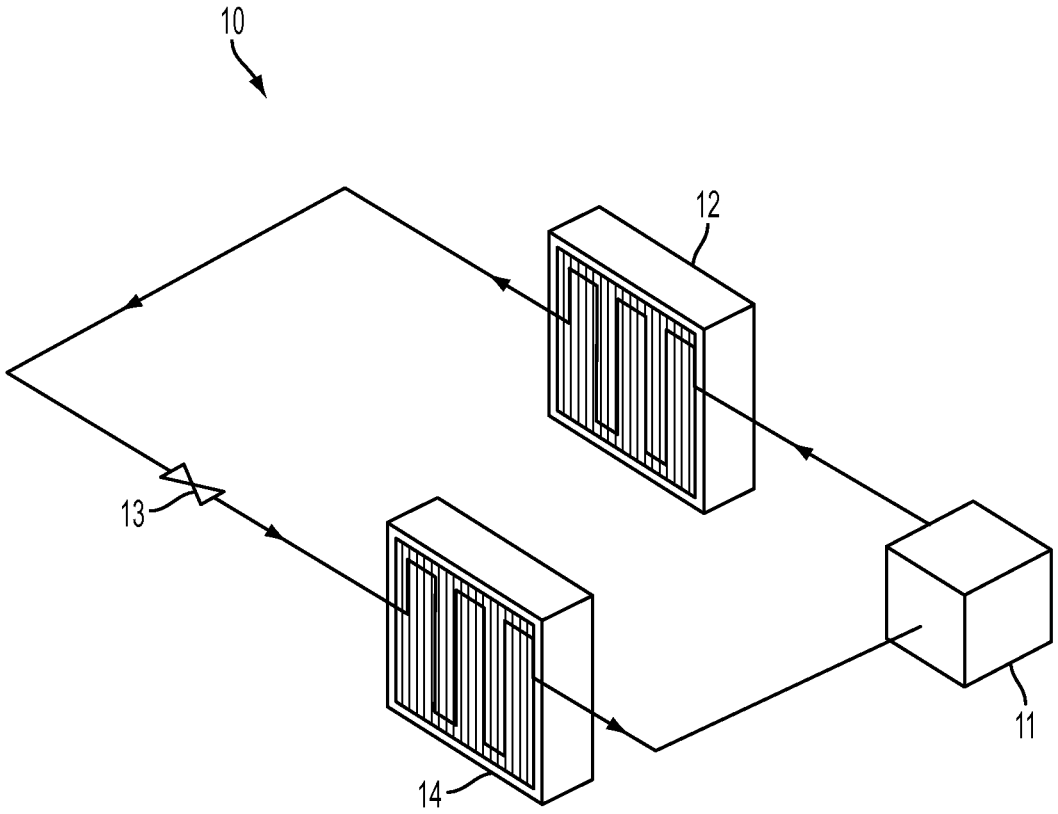
FIG. 1 is a graphical representation of the refrigeration cycle for a conventional air conditioning system.

Referring now to the drawings and in particular FIG. 1, the refrigeration cycle components of a conventional air conditioning system 10 define a compressor 11, a condenser 12, a thermal expansion valve 13, and evaporator 14 connected through a series of conduits (or pipes, tubes) arranged in a continuous, closed loop. It is contemplated that as used throughout this application, a series of conduits may be embodied as a plurality of discrete conduits connecting individual components, a single conduit that flows through each component, or some mix of the two. It is well established that in such conventional systems 10, a refrigerant is circulated through the components in various thermodynamic states, whereby the refrigerant enters the compressor 11 as a relatively low pressure, low temperature vapor where it is compressed to a higher pressure, producing an increase in temperature of said refrigerant. The refrigerant, at a relatively high pressure and vapor temperature, is then directed through the condenser 12 where it is cooled and condensed into a gaseous liquid (or liquid); latent thermodynamic process. The temperature difference across the condenser 12, vapor to saturated vapor (or liquid) property states, is referred to as subcool in thermodynamic terminology. Typically this is achieved by drawing cooler ambient air across the coil of the condenser 12 by mechanical means of a fan or blower. Water source condensers incorporate a fluid cooler or coolers supplying water to heater exchangers by mean of a water pump, transferring refrigerant heat to the water ($2^{nd}$ law of thermodynamics), thus achieving the same function of the aforementioned condenser 12.

The refrigerant in a condensed gaseous liquid state (or liquid) is then directed through the expansion valve 13, either mechanical or electronic, where it flashes, or expands rapidly, undergoing a reduction in pressure resulting in the refrigerant becoming a low temperature gaseous liquid; saturated vapor. This low temperature saturated vapor is then passed through the evaporator 14 where it under goes a phase change; latent thermodynamic process. This process is generally achieved by drawing air across or through the evaporator 14 by means of a fan or blower respectively. Heat is then absorbed from the conditioned space air to the refrigerant; again a latent thermodynamic process. The refrigerant, sufficiently warmer as a consequence of the aforementioned process, exits the evaporator 14 as a saturated vapor or in a liquid state. The previous process temperature difference across the evaporator 14, taking into account sensible considerations, is referred to as super heat in thermodynamic terminology. The refrigerant subsequently enters the compressor 11, sustaining its vapor state, and exits at an elevated temperature and pressure. The compressor 11 gives up heat to both the environment and the refrigerant resulting from the work of compression; a non-isentropic thermodynamic process.

In the refrigeration cycle of an air conditioning system, cooling efficiency and capacity are directly correlated to the temperature of the ambient air passing across the condenser 12. Air directed across the condenser 12 at elevated temperatures is less able to absorb heat from the refrigerant passing through the condenser 12. Warmer than desired refrigerant, passing through the expansion value 13, reduces the ability of the systems' ability to absorb heat by the evaporator 14. Analytical computations substantiate and practical application demonstrate that a conventional air conditioning system subjected to rises in ambient air temperatures across the condenser 12 result in a substantial loss of cooling efficiency to the conventional air conditioning system; which is often when the greatest demand for cooling exists.

Conversely, such conventional systems 10 generally operate at their peak efficiency in moderate or cooler ambient air temperatures. Again, this is because the ambient air drawn across the condenser 12 is cooler and therefore able to absorb more heat from the refrigerant flowing through the condenser 12. The refrigerant exiting the condenser 12 in such circumstances, once passed through the expansion valve 13, provides optimal heat absorption and thus greater cooling efficiency. But notably, such cooler ambient temperatures often require less cooling to create a desired environment, and the achievement of greater efficiency in such circumstances does nothing to improve the efficiency when ambient temperatures rise and a greater demand for space cooling is required.

Figure 2:
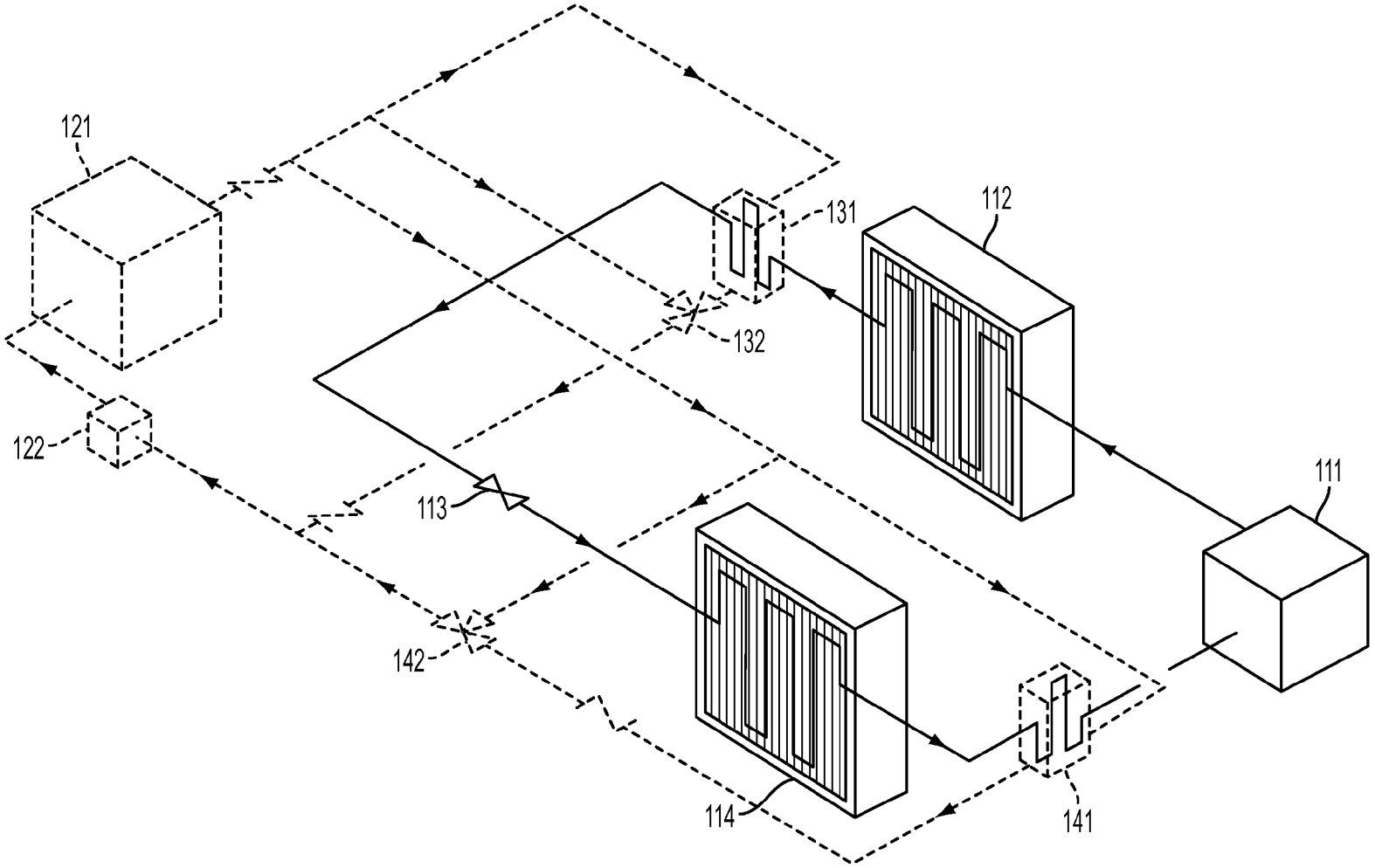
FIG. 2 is a graphical representation of the operational components of an air conditioning companion stabilizer system integrated in the refrigeration cycle of a conventional air conditioning system in accordance with the present invention.
Figure 3:
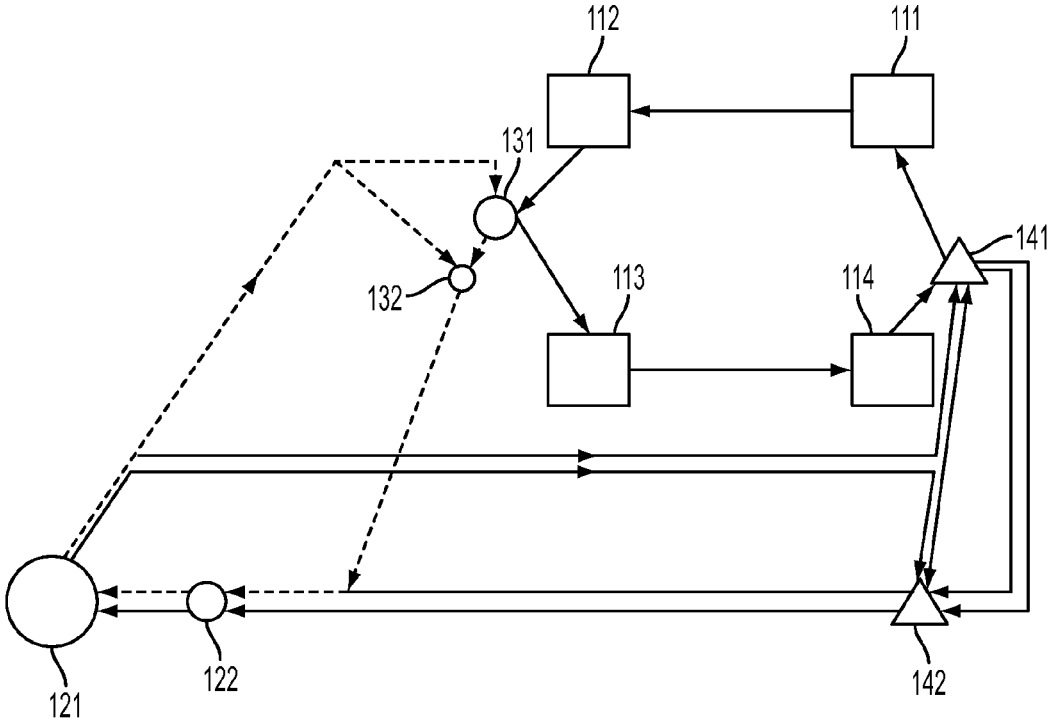
FIG. 3 is a block diagram of the operational components of an air conditioning companion stabilizer system integrated with the refrigeration cycle components of a conventional air conditioning system in accordance with the present invention.
Figure 4:
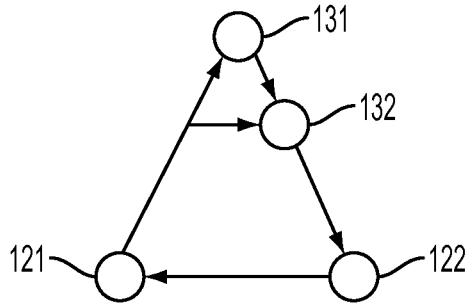
FIG. 4 is a block diagram of the operative components of the primary, stabilizing loop components of an air conditioning companion stabilizer system integrated with the refrigeration cycle components of a conventional air conditioning system in accordance with the present invention.
Figure 5:
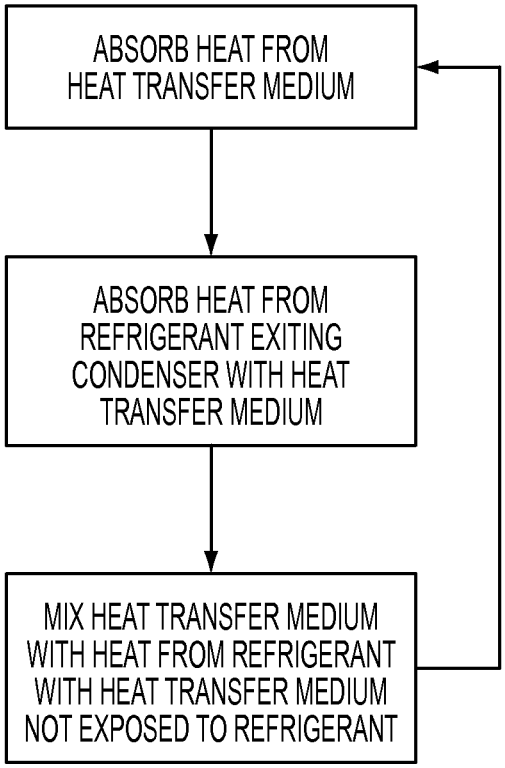
FIG. 5 is a flow chart showing the function of the primary, stabilizing loop components of an air conditioning companion stabilizer system.
Figure 6:
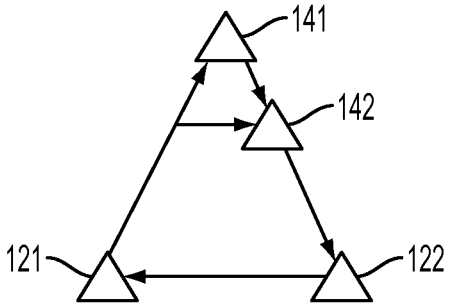
FIG. 6 is a block diagram of the operative components of the secondary, charging loop of an air conditioning companion stabilizer system integrated with the refrigeration cycle components of a conventional air conditioning system in accordance with the present invention.
Figure 7:
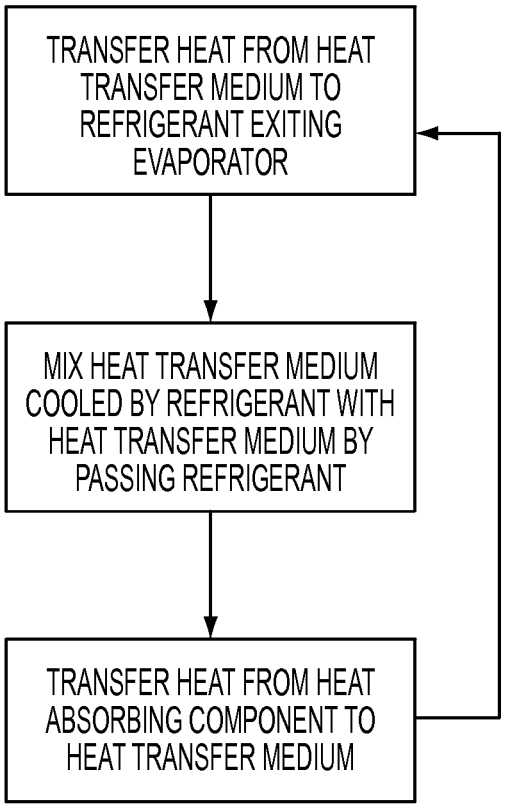
FIG. 7 is a flow chart showing the function of the secondary, charging loop components of an air conditioning companion stabilizer system.

Referring now to FIGS. 2 and 3, an air conditioning companion stabilizer system is operative to function with and improve the operating efficiency of the refrigeration cycle of conventional air conditioning systems. The modified air conditioning system with the air conditioning companion stabilizer system 100 (or "air conditioning companion system") is shown having the compressor 111, condenser 112, expansion valve 113 and the evaporator 114 of conventional air conditioning systems connected by a series of conduits, as well as a two independently operable closed loops that create an artificial operating environment in the refrigeration cycle that maximizes its cooling efficiency by stabilizing the temperature of the refrigerant entering the expansion valve 113 at a desired level. A primary, temperature stabilizing loop of the air conditioning companion system 100 functions to absorb heat from the refrigerant exiting the condenser 112, thereby lowering the temperature of the refrigerant before it arrives at the expansion valve 113. A secondary, charging loop of the air conditioning companion system 100 that facilitates the operation of the temperature stabilizing loop by priming a rechargeable heat absorbing component, defined in one embodiment as an ice storage vessel 121, to absorb heat. While each of the two loops operate separately and at different times, they are interconnected and share an ice storage vessel 121, circulating heat transfer medium, a glycol distribution pump 122 for circulating the heat transfer medium, and the conduits through which the heat transfer medium moves through the loops. The heat transfer medium is defined in one embodiment as a glycol-water mixture (or "glycol solution").

In the preferred embodiment, the ice storage vessel 121 defines the rechargeable heat absorbing component whose operation with the temperature stabilizing loop and the charging loop is detailed below. The glycol solution distribution pump 122 moves the heat transfer medium through whichever closed loop is operational at a given moment. The heat transfer medium is defined in the preferred embodiment as a percentage glycol-water mixture, which is dependent upon the temperature as dictated by the prescribed refrigerant in use. In one embodiment, a forty (40) percent glycol mixture is employed as the glycol solution. The glycol solution is distributed throughout the loops and alternatively circulated through them in the manner detailed below by the glycol solution distribution pump 122.

Referring now to FIGS. 2, 3, 4, and 5, the temperature stabilization loop (or "primary loop") enables a greater cooling efficiency from the refrigeration cycle components. As ambient air temperatures increase at the condenser 112, precluding sufficient heat transfer from the refrigerant, the refrigerant exiting the condenser is at a lesser then ideal saturated vapor (or liquid) temperature exiting the condenser 112 prior to its delivery to the expansion valve 113. As discussed above, when ambient air temperatures rise, refrigerant exiting the condenser 112 has not been optimally cooled by the flowing of the ambient air across the coil of the condenser 112. This is because the hotter ambient air absorbs less heat from the refrigerant passing through the condenser 112 coil. By absorbing additional heat from the refrigerant after it exits the condenser 112, the temperature stabilizing loop stabilizes the temperature of the refrigerant to the optimal temperature for passage to the expansion valve 113, thereby enabling the refrigeration system to operate at a higher efficiency despite the elevated ambient air temperatures The primary loop is shown having a condenser tube and shell heat exchanger 131 located at the coil discharge of the condenser 112, a primary loop three way modulating variable/isolation valve 132 (or "primary loop valve"), the glycol distribution pump 122 and the ice storage vessel 121, all connected by a series of conduits (shown in FIG. 3 as dashed lines) in a closed loop. The condenser heat exchanger 131 provides a glycol refrigerant interface where heat can be transferred between the glycol solution in the primary loop and refrigerant in the conduit between the condenser 112 and the expansion value 113. The glycol solution enters the condenser heat exchanger 131 in a low temperature state emanating from the ice storage vessel 121. Because the primary loop is employed when ambient air is unable to optimally cool the refrigerant passing through the condenser 112, it is contemplated that the refrigerant passing through the condenser heat exchanger 131 is at a higher than desired temperature; one that would generally reduce the cooling efficiency of the air conditioning system. In the heat exchanger 131, the low temperature glycol solution absorbs heat from the refrigerant passing through the condenser heat exchanger 131 as it exits the condenser 112, thereby lowering its temperature to a more desired temperature before it reaches the expansion valve 113. By lowering the temperature of the refrigerant in the condenser heat exchanger 131, it can be stabilized at a temperature that enables optimal or improve cooling efficiency in an environment which normally causes decreased cooling efficiency.

The primary loop valve 132 defines a motorized glycol solution mixing valve that receives circulating glycol solution in the primary loop directly from the ice storage vessel 121 and the condenser heat exchanger 131. In addition to precluding the necessity of variable volume controls on the glycol distribution pump 122, the primary loop valve 132, provides finite control and isolation to and from the condenser heat exchanger 131. In this regard, the primary loop valve 132 is operative to enable flow of glycol solution through the condenser heat exchanger 131 when the primary loop is operational and to restrict all flow of glycol solution through the condenser heat exchanger 131 when the secondary loop is operational.

In operation, the primary loop operates by moving the glycol solution, via the glycol solution distribution pump 122, through the ice storage vessel 121, through the condenser heat exchanger 131 and/or the primary loop valve 132, and then back through the glycol distribution pump 122. In the ice storage vessel 121, static water (a brine solution) which has been frozen (in whole or in part) during the charging loop (described below) absorbs heat from the glycol solution, thereby reducing the temperature of the glycol solution passing there through. The chilled glycol solution is then directed, in some portion, to either the condenser heat exchanger 131 or the primary loop valve 132. The glycol solution directed to the condenser heat exchanger 131 passes through it, absorbs heat from refrigerant that is also passing through the condenser heat exchanger 131, and then moving to the primary loop valve 132. The chilled glycol solution that is directed straight to the primary loop valve 132 is mixed with the glycol solution that just passed through the condenser heat exchanger 131 to provide for the regulation of the glycol solution's temperature. The mixed glycol solution is then directed back to the glycol distribution pump 122 to continue its movement through the temperature stabilizing loop.

Referring now to FIGS. 2, 3, 6 and 7, the charging loop stores facilitates the operation of the primary loop by storing heat absorption capacity in the ice storage vessel 121 when the ambient air temperatures are at their lowest. Essentially storage, ice formation, is at its greatest potential when ambient air temperatures are at their lowest through the improved cooling efficiency of the conventional air conditioner. As discussed above, the primary loop is used when ambient air temperature rises and is operative to absorb heat from refrigerant exiting the condenser 112 coil that had not been optimally cooled by the flowing of the ambient air across the coil of the condenser 112. The capacity to absorb this heat is provided by the ice storage vessel 121, which absorbs heat from the glycol solution circulating in the primary loop prior to interfacing the glycol solution with the refrigerant needing additional cooling. The charging loop facilitates this operation by absorbing heat from the ice storage vessel 121 when the primary loop is not operational, priming it to absorb heat when the primary loop is operating.

The charging loop is employed when space conditioning is not in demand; thus when the charging loop is operational, all of the components of the refrigeration cycle are operative except the evaporator 114 fan, which is taken out of service through control circuitry. The charging loop employs a shell and tube type evaporative heat exchanger 141 located downstream of the coil discharge of the evaporator 114, a charging loop three way modulating variable isolation valve 142 (or "charging loop valve"), the glycol solution distribution pump 122 and the ice storage vessel 121, all connected by a series of conduits (shown in FIG. 3 as double lines) in a closed loop. The evaporative heat exchanger 141 provides a glycol refrigerant interface where heat can be transferred between the glycol solution in the charging loop and refrigerant in a conduit between the evaporator 114 and the compressor 111.

In the charging loop, the glycol solution enters the evaporative heat exchanger 141 at a relatively high temperature state with respect to the refrigerant exiting the evaporator 114. This refrigerant exiting the evaporator 114 remains in a constant temperature state because the evaporator 114 fan is inoperable across the evaporator 114 coils during the charging loop's operation. In the evaporative heat exchanger 141, the low temperature refrigerant absorbs heat from the glycol solution as it passes through, cooling the glycol solution. Through this operation the refrigerant under goes a latent thermodynamic process, warming sufficiently in the sensible phase of the operation, downstream of heat exchanger 141, and directing it as a vapor to the compressor 111 inlet at a relatively low pressure and temperature vapor.

The charging loop valve 142 defines a motorized mixing valve that receives circulating glycol solution in the charging loop directly from the ice storage vessel 121 and the evaporative heat exchanger 141. The charging loop valve 142 thus provides both the function of loop isolation, by mean of bypass, and finite control of the glycol solution distribution pump 122 without it requiring variable volume capabilities. In this regard, the charging loop valve 142 is operative to enable flow of glycol solution through the evaporative heat exchanger 141 when the secondary loop is operational and to restrict all flow of glycol solution through the evaporative heat exchanger 141 when the primary loop is operational.

In operation, the charging loop operates by moving the glycol solution, via the glycol solution distribution pump 122, through the ice storage vessel 121, through the evaporative heat exchanger 141 and/or the charging loop valve 142, which is then fed back through the glycol distribution pump 122. As much of the heat in the glycol solution exiting the evaporative heat exchanger 141 and charging loop valve 142 has been absorbed by the refrigerant, the glycol solution that passes through the ice storage vessel 121 is at a low temperature and absorbs heat from static water in the ice storage vessel 121. This process results in the static water freezing, with the glycol solution warmed from the absorbed heat being directed back to the evaporative heat exchanger 141 or charging loop valve 142 to be cooled and passed repeatedly through the ice storage vessel 121.

Accordingly, the charging loop utilizes the refrigeration cycle components to essentially store heat absorbing capacity as ice in the ice storage vessel 121 while ambient conditions, particularly the ambient air passed over the condenser 112 coil, are favorable for optimal cooling efficiency. When ambient conditions are less favorable or unfavorable, particularly when the ambient air to be passed over the condenser 112 coil is too warm to cool the refrigerant to a desired temperature, this stored cooling capacity can then be used by the primary loop to absorb additional heat from refrigerant exiting the condenser 112, thereby reducing or eliminating the inefficiency customarily caused by ambient air that is too warm. In this regard, substantial net energy savings is achieved using saved heat absorbing capacity produced during a time of optimal cooling efficiency and low space cooling demand to improve performance during times of reduced cooling efficiency and high space cooling demand.

With the primary loop and the charging loop sharing the ice storage vessel 121, the glycol distribution pump 122, the glycol solution and the tubes through which the glycol solution flows, controlling which loop is operational at a given time is done through the primary loop valve 132 and the charging loop valve 142, both operated through control circuitry. When the primary loop is operational, with the glycol solution being chilled by in the ice storage vessel 121 and warmed in the condenser heat exchanger 131 (thereby cooling refrigerant), the charging loop valve 142 is set to block all flow of glycol solution from the evaporative heat exchanger 141, effectively eliminating the evaporative heat exchanger 141 from the system's circulation because 100% of the glycol solution is forced to bypass the evaporative heat exchanger 141. Conversely, when secondary loop is operational, with the glycol solution being chilled by in the evaporative heat exchanger 141 and warmed in the ice storage vessel 121 (thereby cooling the static water), the primary loop valve 132 is set to block all flow of glycol solution from the condenser heat exchanger 131, effectively eliminating the condenser heat exchanger 131 from the system's circulation because 100% of the glycol solution is forced to bypass the condenser heat exchanger 131. This enables the exclusive operation of two distinct loops that perform opposing functions through essentially the same system of components and conduits.

It is contemplated that in many implementations for conventional seasonal temperature fluctuations, the charging loop would operate during late evening or early morning periods while the primary loop would run in the afternoon or early evening hours.

The instant invention has been shown and described herein in what is considered to be the most practical and preferred embodiment. It is recognized, however, that departures may be made therefrom within the scope of the invention and that obvious modifications will occur to a person skilled in the art including the fields of thermodynamics and refrigeration mechanics, enhancing the overall systems' capabilities and value.

For ease of reference, the following glossary is provided relating to terms and concepts discussed above.

Latent thermodynamic process: Defined as a constant enthalpy (BTU/lb) process from the saturated liquid line to the saturated vapor line, as found in a Pressure-Enthalpy diagram. Additionally, pressure and temperature remain constant, known as isobaric and isothermal, respectively, through the aforementioned process. The thermal dynamic process of changing a substance phase; for example, water to ice.

Enthalpy: a quantity associated with a thermodynamic system, expressed as the internal energy of a system plus the product of the pressure and volume of the system, having the property that during an isobaric process, the change in the quantity is equal to the heat transferred during the process.

Isobaric: having or showing equal barometric pressure

Isothermal: occurring at constant temperature.

Isotropic: of equal physical properties along all axes.

Entropy: a. (on a macroscopic scale) a function of thermodynamic variables, as temperature, pressure, or composition, that is a measure of the energy that is not available for work during a thermodynamic process. A closed system evolves toward a state of maximum entropy. b. (in statistical mechanics) a measure of the randomness of the microscopic constituents of a thermodynamic system.

Sensible thermodynamic process: heat exchanged by a body or thermodynamic system that changes the temperature, and some macroscopic variables of the body, but leaves unchanged certain other macroscopic variables, such as volume or pressure.

Subcool: The measure of the temperature difference between saturated vapor (or liquid) and vapor, at constant pressure, as it applies to the condensing coil of an air conditioning unit.

Superheat: The measure of the temperature difference between saturated vapor (or liquid) and vapor, at a constant pressure, as it applies to the evaporative coil of an air conditioning unit.

2nd Law of Thermodynamics: states that the entropy of an isolated system never decreases, because isolated systems always evolve toward thermodynamic equilibrium, a state with maximum entropy; heat always transfers higher temperature medium to a lower temperature medium.

What is claimed is:

1. An air conditioning companion stabilizer system, comprising:

a condenser heat transfer medium movably disposed in a closed, discrete stabilizing loop that includes a condenser glycol refrigerant interface, a pump, and a rechargeable heat absorbing component connected through at least one conduit;

wherein the condenser glycol refrigerant interface is operative to enable a transfer of heat between the condenser heat transfer medium and refrigerant exiting a condenser of an air conditioning system;

wherein the rechargeable heat absorbing component is operative to absorb heat from the condenser heat transfer medium;

wherein said pump is operative to cycle the condenser heat transfer medium sequentially between the condenser glycol refrigerant interface and the rechargeable heat absorbing component, thereby enabling heat from the refrigerant to be absorbed in the rechargeable heat absorbing component; and wherein said stabilizing loop additionally includes a first mixer valve configured to mix condenser heat transfer medium exiting the rechargeable heat absorbing component with condenser heat transfer medium exiting the condenser glycol refrigerant interface.

2. The air conditioning companion stabilizer system of claim 1, wherein said first mixer valve is defined as a first three way modulating variable/isolation valve.

3. The air conditioning companion stabilizer system of claim 1, wherein said condenser glycol refrigerant interface defines a condenser shell and tube heat exchanger.

4. The air conditioning companion stabilizer system of claim 1, wherein said condenser heat transfer medium defines a glycol and water solution mix to a percentage supporting a prescribed refrigerant temperature range in a refrigeration cycle.

5. The air conditioning companion stabilizer system of claim 1, wherein the rechargeable heat absorbing component defines an ice storage vessel.

6. The air conditioning companion stabilizer system of claim 1, wherein an evaporative heat transfer medium defines a forty percent glycol and water solution mix to a percentage supporting a prescribed refrigerant temperature range in a refrigeration cycle.

7. An air conditioning companion stabilizer system, comprising:

a condenser heat transfer medium movably disposed in a closed, discrete stabilizing loop that includes a condenser glycol refrigerant interface, a pump, and a rechargeable heat absorbing component connected through at least one conduit;

wherein the condenser glycol refrigerant interface is operative to enable a transfer of heat between the condenser heat transfer medium and refrigerant exiting a condenser of an air conditioning system;

wherein the rechargeable heat absorbing component is operative to absorb heat from the condenser heat transfer medium;

wherein said pump is operative to cycle the condenser heat transfer medium sequentially between the condenser glycol refrigerant interface and the rechargeable heat absorbing component, thereby enabling heat from the refrigerant to be absorbed in the rechargeable heat absorbing component;

an evaporative heat transfer medium movably disposed in a closed, discrete charging loop that includes an evaporative glycol refrigerant interface, the pump and the rechargeable heat absorbing component connected through at least one conduit;

wherein the evaporative glycol refrigerant interface is operative to enable a transfer of heat between the evaporative heat transfer medium and refrigerant exiting an evaporator of the air conditioning system configured without an evaporator fan operating;

wherein the evaporative heat transfer medium is operative to absorb heat from the rechargeable heat absorbing component; and wherein said pump is operative to cycle the evaporative heat transfer medium sequentially between the evaporative glycol refrigerant interface and the rechargeable heat absorbing component when the pump is not cycling condenser heat transfer medium, thereby enabling heat from the rechargeable heat absorbing component to be absorbed by the refrigerant.

8. The air conditioning companion stabilizer system of claim 7, wherein said charging loop additionally includes a second mixer valve configured to mix evaporative heat transfer medium exiting the rechargeable heat absorbing component with evaporative heat transfer medium exiting the evaporative glycol refrigerant interface.

9. The air conditioning companion stabilizer system of claim 8, wherein said second mixer valve is defined as a second three way modulating variable/isolation valve.

10. The air conditioning companion stabilizer system of claim 7, wherein said evaporative glycol refrigerant interface defines an evaporative shell and tube heat exchanger.

11. A method of improving a cooling efficiency of refrigeration cycle components, comprising the steps of:

interfacing an evaporative heat transfer medium with refrigerant exiting an evaporator configured without an evaporative fan operating, enabling heat from the evaporative heat transfer medium to be absorbed by the refrigerant having exited the evaporator;

interfacing said evaporative heat transfer medium with a rechargeable heat absorbing component, thereby enabling the evaporative heat transfer medium to absorb heat from the rechargeable heat absorbing component; and additionally comprising the step of mixing the evaporative heat transfer medium exiting the interface with the rechargeable heat absorbing component with evaporative heat transfer medium exiting the interface with the evaporator.

12. The method of improving the cooling efficiency of refrigeration cycle components of claim 11, wherein the step of mixing the evaporative heat transfer medium is performed by a second three way modulating variable/isolation valve.

13. The method of improving the cooling efficiency of refrigeration cycle components of claim 11, wherein the step of interfacing the evaporative heat transfer medium with refrigerant is performed by an evaporative heat exchanger.

14. The method of improving the cooling efficiency of refrigeration cycle components of claim 13, wherein the rechargeable heat absorbing component defines an ice storage vessel.

15. The method of improving the cooling efficiency of refrigeration cycle components of claim 13, wherein an evaporator glycol refrigerant interface defines an evaporative shell and tube heat exchanger.

16. The method of improving the cooling efficiency of refrigeration cycle components of claim 13, wherein said evaporative heat transfer medium and a condenser heat transfer medium each defines discrete portions of a glycol and water solution mix to a percentage supporting a prescribed refrigerant temperature range in a refrigeration cycle.

17. The method of improving the cooling efficiency of refrigeration cycle components of claim 11, additionally comprising the steps of:

interfacing a condenser heat transfer medium with the rechargeable heat absorbing component, thereby enabling the rechargeable heat absorbing component to absorb heat from the condenser heat transfer medium; and interfacing said condenser heat transfer medium with refrigerant exiting a condenser, thereby enabling heat from the refrigerant exiting the condenser to be absorbed by the condenser heat transfer medium.

18. A method of improving a cooling efficiency of refrigeration cycle components, comprising the steps of:

interfacing an evaporative heat transfer medium with refrigerant exiting an evaporator configured without an evaporative fan operating, enabling heat from the evaporative heat transfer medium to be absorbed by the refrigerant having exited the evaporator;

interfacing said evaporative heat transfer medium with a rechargeable heat absorbing component, thereby enabling the evaporative heat transfer medium to absorb heat from the rechargeable heat absorbing component; wherein the step of interfacing the evaporative heat transfer medium with refrigerant is performed by an evaporative heat exchanger: and additionally comprising the step of mixing a condenser heat transfer medium exiting an interface with a condenser with condenser heat transfer medium exiting the interface with the rechargeable heat absorbing component.

19. The method of improving the cooling efficiency of refrigeration cycle components of claim 18, wherein the step of mixing the condenser heat transfer medium is performed by a first three way modulating variable/isolation valve.

* * * * *